US006112639A

United States Patent [19]

Kimura et al.

[11] Patent Number: 6,112,639

[45] Date of Patent: Sep. 5, 2000

[54] STRUCTURE FOR COLLECTING LEAKING OIL IN COMPRESSOR

[75] Inventors: Kazuya Kimura; Masafumi Ito, both of Kariya, Japan

[73] Assignee: Kabushiki Kaisha Toyoda Jidoshokki Seisakusho, Kariya, Japan

[21] Appl. No.: 09/117,425

[22] Filed: Jul. 29, 1998

[30] Foreign Application Priority Data

Dec. 18, 1995 [JP] Japan ..... 7-329197

[51] Int. Cl.[7] ..... F01L 29/06

[52] U.S. Cl. ..... 92/12.2; 91/57; 91/71; 417/269

[58] Field of Search ..... 92/12.2, 57, 71; 417/269

[56] References Cited

U.S. PATENT DOCUMENTS

| | | | |
|---|---|---|---|
| 4,979,877 | 12/1990 | Shimizu | 92/71 X |
| 5,644,970 | 7/1997 | Michiyuki et al. | 92/71 |
| 5,809,863 | 9/1998 | Tominaga et al. | 92/71 X |
| 5,941,693 | 8/1999 | Kato | 92/71 X |

FOREIGN PATENT DOCUMENTS

| | | |
|---|---|---|
| 52-80103 | 6/1977 | Japan . |
| 55-39328 | 3/1980 | Japan . |
| 58-8764 | 1/1983 | Japan . |
| 1-124394 | 8/1989 | Japan . |
| 6-67871 | 9/1994 | Japan . |
| 7-145780 | 6/1995 | Japan . |

*Primary Examiner*—Hoang Nguyen
*Attorney, Agent, or Firm*—Morgan & Finnegan, L.L.P.

[57] ABSTRACT

A housing (11, 12, 13) accommodates a compressive mechanism. A drive shaft (15) is supported by the housing (11, 12, 13) and is connected with the compressive mechanism. A boss portion (16) is arranged along an outer wall of the housing (11, 12, 13) such that the boss portion (16) encompasses a portion of the drive shaft (15) projecting from the housing (11, 12, 13). A rotational body (18) is connected with the drive shaft (15) for transmitting drive force from an exterior drive source to the drive shaft (15). A seal (17) is arranged in the interior of the housing (11, 12, 13) for sealing at a location between the inner side of the housing (11, 12, 13) and the drive shaft (15). A collector (35, 36, 38) collects oil leaking from the seal (17). A stepped portion (40) is formed on an outer surface of a rotary portion (15, 21α) at a position between the seal (17) and an opening (16α) of the boss portion (16) within the interior of the housing (11, 12, 13). The stepped portion (40) is opposed to the collector (35, 36, 38).

16 Claims, 5 Drawing Sheets

STRUCTURE FOR COLLECTING LEAKING OIL IN COMPRESSOR

BACKGROUND OF THE INVENTION

The present invention relates to compressors used in, for example, air conditioners mounted on vehicles, and, more specifically, to structures for collecting oil leaking from the interior of the compressors.

A typical compressor is described, for example, in Japanese Unexamined Utility Model Publication No. 55-39328. Specifically, as shown in FIG. 5, a drive shaft 51 is supported by a housing 52 accommodating a compressing mechanism. The drive shaft 51 is connected with the compressing mechanism while a portion of the shaft 51 projects from the housing 52. A boss portion 53 is arranged along an outer wall of the housing 52 such that the boss portion 53 encompasses the projecting end of the drive shaft 51. A seal 54 is arranged between the boss portion 53 and the drive shaft 51, thus sealing the housing 52. An electromagnetic clutch 55 includes a rotor 56, which is rotationally supported by the boss portion 53. An armature 57 of the electromagnetic clutch 55 is secured to the projecting end of the drive shaft 51 by a hub 58.

When a core 59 arranged near the rotor 56 is excited, the armature 57 is pressed against the rotor 56. The drive force of the vehicle engine is thus transmitted to the drive shaft 51. The drive shaft is then rotated to activate the compressing mechanism, and refrigerant gas is compressed.

In the above compressor, heat is generated by friction between the drive shaft 51, which is continuously rotated, and the seal 54. The heat hardens the seal. Furthermore, the seal deteriorates over time, and foreign objects may be caught by the seal. The performance of the seal 54 is thus lowered, and lubricant oil in the housing 52 leaks to the exterior of the housing 52 through an opening 53α of the boss portion 53. The lubricant oil adheres to, for example, the opposed surfaces of the armature 57 and the rotor 56. Thus, the armature 57 slips on the rotor 56, and the power transmitting efficiency is lowered.

Therefore, the compressor described in Japanese Unexamined Utility Model Publication No. 55-39328 includes a ring stopper 60 arranged along the inner side of the boss portion 53. The ring stopper 60 is located between the seal 54 and the opening 53α of the boss portion 53. The stopper 60 stops lubricant oil moving along the inner surface of the boss portion 53 toward the opening 53α. An oil absorber 61 is held by the housing 52. The boss portion 53 has an interior space from which an oil passage 62 extends to the oil absorber 61. The oil passage 62 has an opening located at a position corresponding to the inner side of the boss portion 53 and between the stopper 60 and the seal 54. Thus, the lubricant oil stopped by the stopper 60 is guided by the oil passage 62 to the oil absorber 61. The oil is then absorbed by the oil absorber 61.

However, some lubricant oil forms a film and moves along the surface of the drive shaft 51. Furthermore, a clearance is defined between the drive shaft 51 and the stopper 60 so that no sliding resistance is caused between the stopper 60 and the shaft 51. Thus, in the above described compressor, the lubricant oil moving along the surface of the drive shaft 51 is not guided to the oil absorber 61 and does not escape from the drive shaft 51 into the space between the stopper 60 and the seal 54.

To solve this problem, for example, Japanese Unexamined Utility Model Publication No. 1-124394 describes an arrangement of a ring 63, as indicated by the double dotted chain line in FIG. 5. The ring 63 extends along the surface of the drive shaft 51 at a position corresponding to the space between the stopper 60 and the seal 54. The ring 63 stops the lubricant oil moving along the surface of the drive shaft 51. Centrifugal force urges this lubricant oil to enter the space between the stopper 60 and the seal 54.

However, the compressor described in Japanese Unexamined Utility Model Publication No. 1-124394 has the following problems:

(1) The ring 63 must be formed independently from the drive shaft 51. The number of the compressor parts thus increases.

(2) When assembling the compressor, the ring 63 must be fitted onto the drive shaft 51. The number of the assembly steps thus increases. Furthermore, the assembly must be performed in a restricted order. Specifically, the seal 54 must be placed at a predetermined position between the drive shaft 51 and the boss portion 53 before attaching the ring 63 around the drive shaft 51. In other words, the drive shaft 51 must be inserted in the housing 52 without the ring 63. Thus, the ring 63 must be fitted to the drive shaft 51 within the interior space of the boss portion 53, which is limited, and the assembly is complicated.

(3) The ring 63, which projects toward the inner side of the boss portion 53, shields the seal 54 from the exterior of the housing 52. The temperature thus increases in the vicinity of the seal 54, which deteriorates the seal 54.

SUMMARY OF THE INVENTION

To solve this problem, it is an objective of the present invention to provide a structure for collecting leaking oil in a compressor that is simply constructed without increasing the number of the compressor parts and enables oil moving along a drive shaft to fall at a predetermined position within a housing.

To achieve this objective, the compressor according to the present invention includes a housing that accommodates a compressing mechanism. A drive shaft is supported by the housing and is connected with the compressing mechanism. A boss is arranged on an outer wall of the housing such that the boss encompasses a portion of the drive shaft that projects from the housing. A rotatable body is connected with the drive shaft for transmitting drive force from an exterior drive source to the drive shaft. A seal is arranged in the interior of the housing for sealing at a location between the inner surface of the housing and the drive shaft. A collecting means collects oil leaking from the seal. A stepped portion is formed on an outer surface of a rotary portion at a position between the seal and an opening of the boss within the interior of the housing. The stepped portion is opposed to the collecting means.

Therefore, according to the present invention, if oil leakage is caused by decreasing seal performance of the seal, the collecting means collects the oil moving along the inner side of the boss. The oil thus does not leak through the opening of the boss toward the rotatable body.

Furthermore, the oil film moving along the drive shaft is retained in the stepped portion provided in rotary portions such as the drive shaft and the rotatable body. Centrifugal force urges the oil to escape toward the inner side of the boss. Subsequently, the oil is collected by the collecting means in the same manner as described above.

BRIEF DESCRIPTION OF THE DRAWINGS

FIG. 2(*b*) is an enlarged view showing a main portion of FIG. 2(*a*);

FIG. 3(*b*) is a front view showing a portion of a hub of the second embodiment;

FIG. 4(*b*) is a rear view showing a portion of a rubber bumper of the third embodiment.

DETAILED DESCRIPTION OF THE PREFERRED EMBODIMENTS

Figure 1:
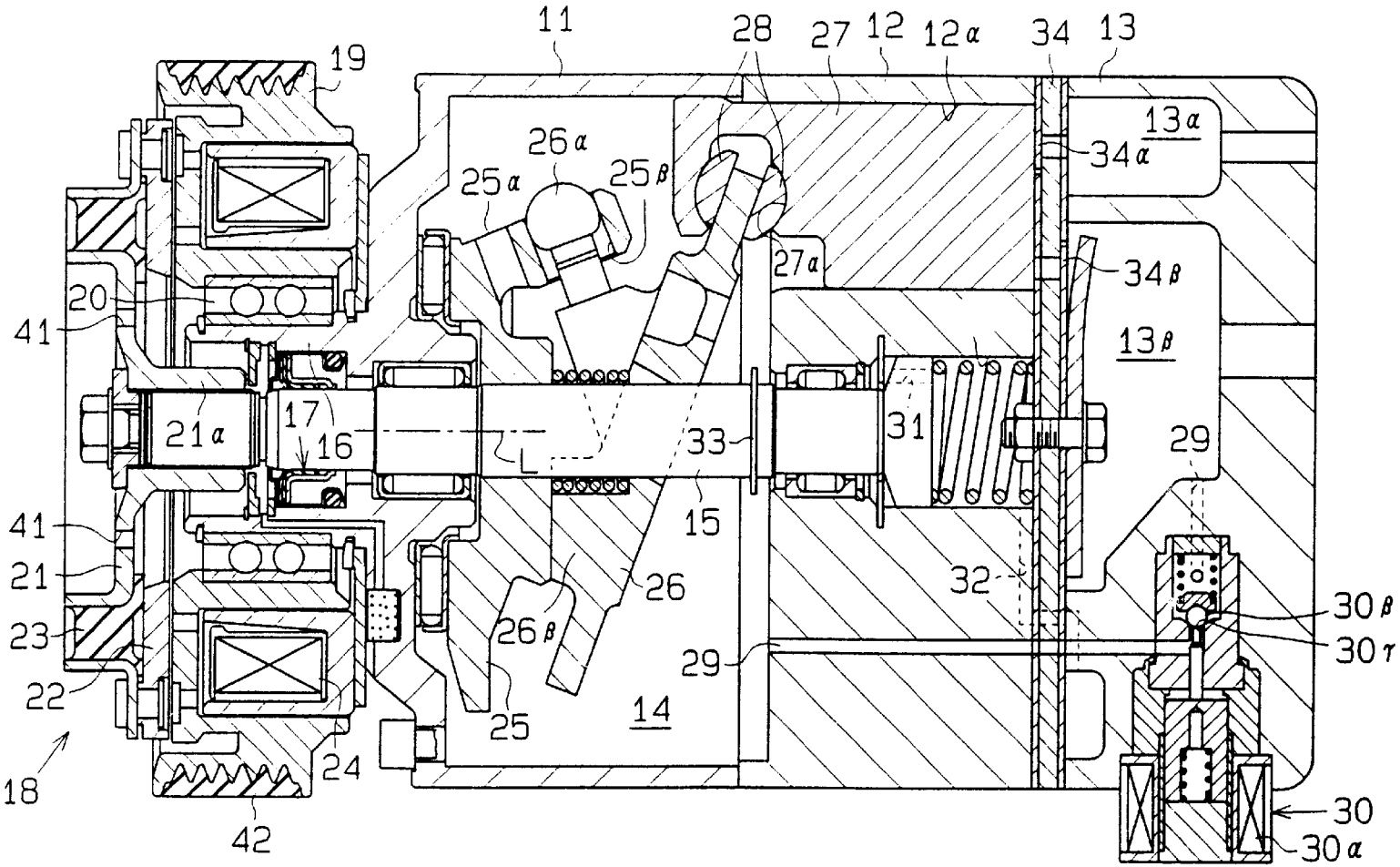
FIG. 1 is a vertical cross-sectional view showing a compressor of a first embodiment according to the present invention.

Embodiments of compressors used in air conditioners mounted on vehicles according to the present invention will now be described. In the second and third embodiments, like or same reference numerals are given to those components that are like or the same as the corresponding components of the first embodiment.

(First Embodiment)

The first embodiment will be described with reference to FIGS. 1 and 2. As shown in FIG. 1, a front housing 11 is securely coupled with the front side of a cylinder block 12. A rear housing 13 is securely coupled with the rear side of the cylinder block 12 with a valve plate 34 arranged therebetween. A crank chamber 14 is defined in the front housing 11 by the cylinder block 12. A drive shaft 15 is rotationally supported by the front housing 11 and the cylinder block 12, thus it extends through the crank chamber 14. The distal portion of the drive shaft 15 projects outward from the front housing 11. A boss portion 16 is formed integrally with an outer wall of the housing 11 so that the boss portion 16 encompasses the projecting portion of the drive shaft 15.

Figure 2A:
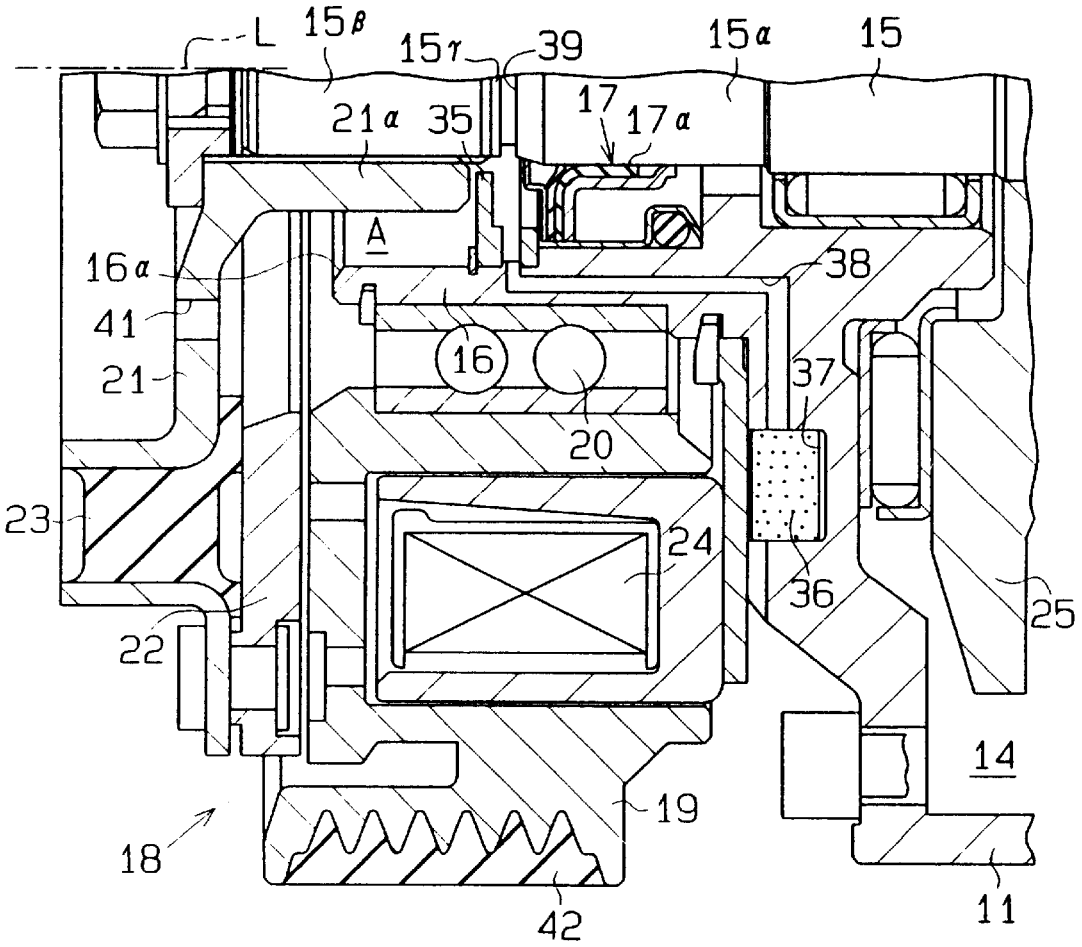
FIG. 2(*a*) is an enlarged view showing a main portion of FIG. 1.
Figure 2B:
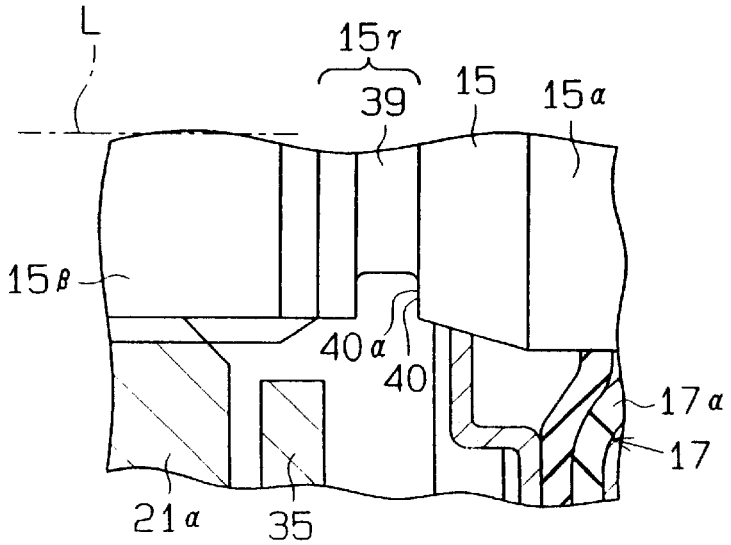

As shown in FIG. 2, a lip seal 17 serving as a shaft seal is arranged in the interior space of the boss portion 16. The lip seal 17 includes a lip ring 17α, which is pressed against the drive shaft 15 by pressure in the crank chamber 14 such that the crank chamber 14 is sealed.

An electromagnetic clutch 18, or a rotational body, connects the drive shaft 15 with an automobile engine (not shown), or an exterior drive source. Specifically, the electromagnetic clutch 18 includes a rotor 19, which is connected to the outer side of the boss portion 16 by an angular bearing 20 such that the rotor 19 rotates. A belt 42 connected with the automobile engine is arranged along the outer side of the rotor 19. A hub, or rotating member 21 is connected with the projecting portion of the drive shaft 15 by a bushing 21α, which is arranged at the center of the hub 21. The bushing 21α is formed integrally with the hub 21. An armature 22 is secured to the hub 21 by a ring-like rubber bumper 23. The rubber bumper 23 is located in the power transmission path between the hub 21 and the armature 22. Resiliency of the bumper 23 suppresses periodic variation in the drive torque transmitted to the belt 42 by the rotor 19.

By exciting a core 24 arranged within the rotor 19, the armature 22 is pressed against the rotor 19, regardless of the resiliency of the bumper 23 supporting the armature 22. The drive force of the automobile engine is thus transmitted to the drive shaft 15. Furthermore, by de-exciting the core 24, the armature 22 is separated from the rotor 19 by the resiliency of the bumper 23, thus cutting off the drive force transmission.

A compressive mechanism accommodated in the crank chamber 14 will now be described.

As shown in FIG. 1, a lug plate 25 is securely fitted around the drive shaft 15. A support arm 25α of the lug plate 25 has a guide hole 25β. A swash plate 26 is supported by the drive shaft 15 such that the plate 26 tilts with respect to the drive shaft 15 and slides along the shaft 15. A guide pin 26α is secured to the swash plate 26 such that the pin 26α engages with the guide hole 25β. Thus, the swash plate 26 tilts with respect to the axis L and rotates integrally with the drive shaft 15.

Cylinder bores 12α are defined in the cylinder block 12. The crank chamber 14 is connected with a suction chamber 13α and a discharge chamber 13β, both defined in the rear housing 13, by each cylinder bore 12α. A single head piston 27 is accommodated in the cylinder bore 12α. A portion of the swash plate 26 is received in a recess 27α defined in the piston 27. The swash plate 26 is connected with the piston 27 by a pair of shoes 28. When the swash plate 26 is rotated, the shoes 28 reciprocate the single head piston 27 forward and rearward. In this state, the refrigerant gas in the suction chamber 13α is drawn into the cylinder bore 12α through a suction valve 34α of the valve plate 34. The refrigerant gas is then compressed and discharged into the discharge chamber 13β through a discharge valve 34β.

A pressurizing line 29 extends from the discharge chamber 13β to the crank chamber 14. An electromagnetic valve 30 is arranged in the pressurizing line 29. When a solenoid 30α of the valve 30 is excited, a spool 30β opens a port 30γ such that the pressurizing line 29 opens. When the solenoid 30α is de-excited, the spool 30β closes the port 30γ such that the pressurizing line 29 closes.

By selectively opening and closing the pressurizing line 29, difference between the pressure in the crank chamber 14 applied to the front side of the piston 27 and the pressure in the cylinder bore 12α applied to the rear side of the piston 27 is varied. The tilt angle of the swash plate 26 is thus controlled.

Specifically, when the pressurizing line 29 is closed, the pressure in the crank chamber 14 is released only into the suction chamber 13α through a depressurizing hole 31 and a depressurizing line 32. In this manner, the difference between the pressure in the crank chamber 14 and the pressure in the suction chamber 13α decreases. Consequently, the swash plate 26 is held at the maximum tilt angle such that the piston stroke increases, thus increasing the displacement. However, when the pressurizing line 29 is open, the high pressure in the discharge chamber 13β is communicated to the crank chamber 14, and the pressure in the crank chamber 14 increases. As a result, the swash plate 29 is held at the minimum tilt angle, thus decreasing the displacement.

The maximum tilt angle of the swash plate 26 is determined by a stopper 26β provided on the swash plate 26, which abuts against the lug plate 25. Meanwhile, the minimum tilt angle of the swash plate 26 is determined by a ring 33 arranged around the drive shaft 15, which is abutted by the swash plate 26.

Features of this embodiment will now be described.

As shown in FIGS. 2(*a*) and 2(*b*), a ring stopper 35 is secured to the inner side of the boss portion 16 at a position between an opening 16α of the boss portion 16 and the lip seal 17. A felt oil absorber 36 is received in a recess 37 defined in the lower portion of the outer wall of the front housing 11. An oil passage 38 is defined along the inner side of the boss portion 16 and the outer wall of the front housing 11. The oil passage 38 extends from the interior space of the boss portion 16 to the oil absorber 36. The oil passage 38 has an opening at a position corresponding to the inner side of the boss portion 16 between the stopper 35 and the lip seal 17. In this embodiment, the stopper 35, the oil absorber 36, the oil passage 38, and the like define a collecting means. Furthermore, it is preferred that the recess 37 is located below a horizontal plane passing through the axis L of the drive shaft 15 (the compressor is arranged in an engine compartment with the axis L extending substantially horizontal).

The outer diameter of a portion of the drive shaft 15 between a portion 15α contacting the lip seal 17 and a portion 15β supporting the bushing 21α of the hub 21 is smaller than those of the portions 15α, 15β. This portion, or a small diameter portion 15γ of the drive shaft 15, has an annular groove 39 located at a position corresponding to the space between the lip seal 17 and the stopper 35 of the collecting means. A corner portion extending from the bottom of the groove 39 toward a wall 40α is curved. The wall 40α is the proximal wall of the groove 39 and the opposite, or distal, wall is unnumbered. A step formed near the lip seal 17 defining the groove 39 is a stepped portion 40 or centrifugal barrier surface. The wall 40α of the stepped portion 40 extends substantially perpendicular to the axis L.

A plurality of through holes 41, each serving as a pressure adjusting means, or airflow device, extend through the hub 21 of the electromagnetic clutch 18 at positions opposed to the opening 16α of the boss portion 16. Thus, though the armature 22 is pressed against the rotor 19, space A defined by the electromagnetic clutch 18 and the boss portion 16 communicates with the exterior of the compressor through the holes 41.

If the seal performance of the lip seal 17 is lowered, the lubricant oil in the crank chamber 14 leaks from the lip seal 17. The lubricant oil moves along the inner side of the boss portion 16 toward the opening 16α. However, the stopper 35 stops the lubricant oil so that the oil does not proceed beyond the stopper 35. In this manner, the oil is retained in the lower portion of the interior space of the boss portion 16 at a position between the stopper 35 and the lip seal 17. The retained oil flows from the opening of the oil passage 38 to the oil absorber 36. The oil is then absorbed by the oil absorber 36.

Some leaked lubricant oil forms a film along the surface of the drive shaft 15 while moving toward the opening 16α of the boss portion 16. However, the stepped portion 40 of the annular groove 39 prevents the oil film from proceeding further toward the opening 16α. Specifically, since the wall 40α of the stepped portion 40 extends substantially perpendicular to the axis L, centrifugal force produced by rotation of the drive shaft 15 prevents the oil moving along the surface of the drive shaft 15 from proceeding along the wall 40α toward the axis L.

Therefore, the lubricant oil is stopped at the edge of the stepped portion 40 and then urged by centrifugal force to escape in a radial direction perpendicular to the axis L. The weight of the oil acts to send the oil to the oil absorber 36 via the oil passage 38. The oil is then absorbed by the oil absorber 36.

Figure 5:
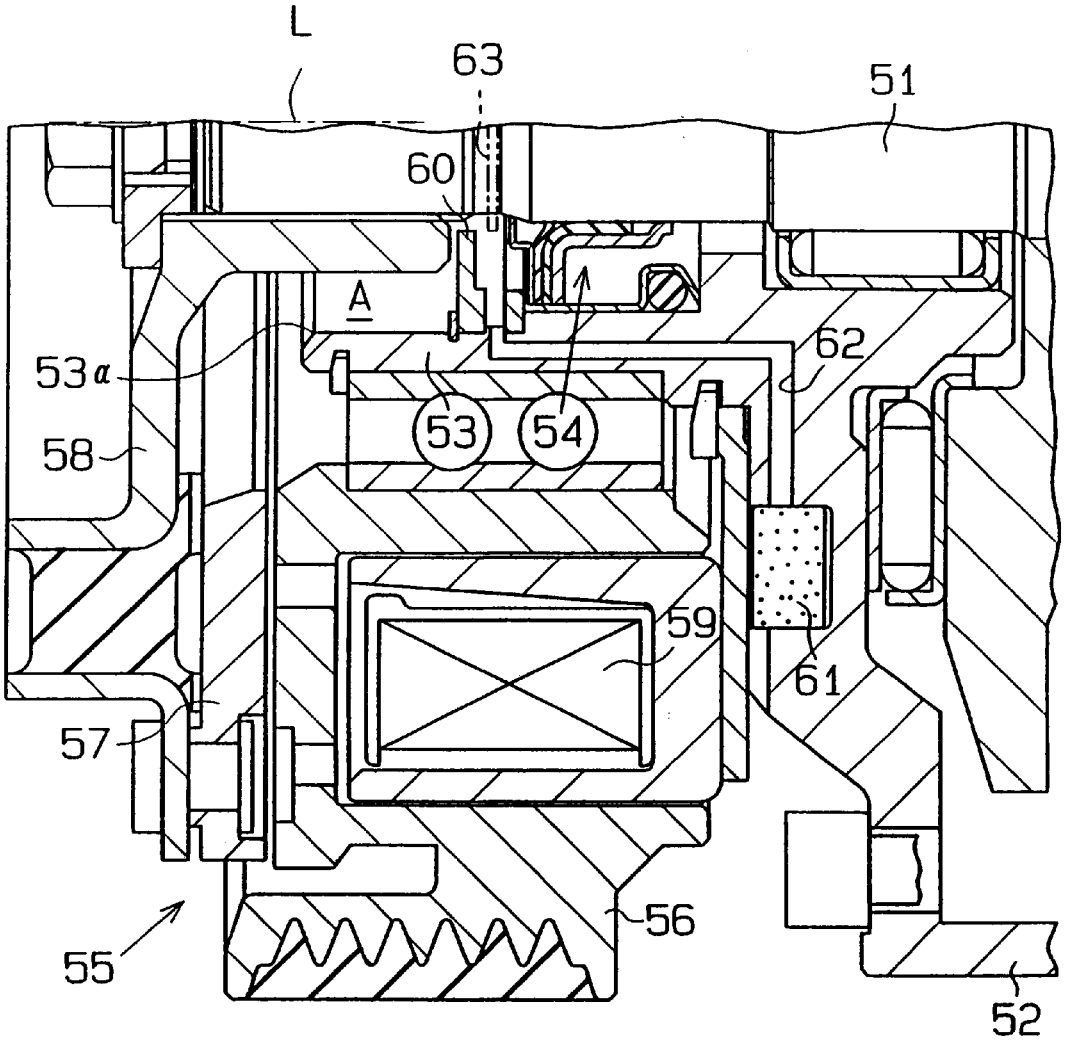
Fig.5 (Prior Art)
FIG. 5 is an enlarged cross-sectional view showing a main portion of a prior art compressor.

In the prior art compressor shown in FIG. 5, when the drive shaft 51 is rotated at a relatively high speed, the pressure in space A, which is defined by the electromagnetic clutch 55 and the boss portion 53, becomes negative. This is believed to be caused by centrifugal force acting to force the air in space A outward through a narrow space between the armature 57 and the rotor 56 of the electromagnetic clutch 55 while they are pressed against each other due to excitation of the core 59. This negative pressure hinders the flow of the lubricant oil in the oil passage 62, and the oil is urged to proceed beyond the stopper 60 to flow toward the opening 53α of the boss portion 53.

However, in the first embodiment, the space A defined by the electromagnetic clutch 18 and the boss portion 16 is communicated with the exterior of the compressor by the through holes 41 extending through the hub 21 of the clutch 18. Thus, the pressure in the space A is maintained positive, and the lubricant oil does not proceed beyond the stopper 35.

As described above, almost all lubricant oil leaked from the lip seal 17 is collected by the oil absorber 36. Thus, problems such as sliding of the armature 22 on the rotor 19 due to the oil leaked through the opening 16 of the boss portion 16 are prevented.

The first embodiment has the following advantages:

(1-1) Simply by defining the annular groove 39 along the surface of the drive shaft 15, the lubricant oil moving along the surface of the drive shaft 15 is guaranteed to be urged to escape into the space between the stopper 35 and the lip seal 17. Furthermore, since the number of the parts is not increased, the compressor is assembled by the same number of steps.

(1-2) Since the annular groove 39 does not obstruct the interior space of the boss portion 16, the lip seal 17 is not shielded. The temperature in the vicinity of the lip seal 17 thus does not increase, and no thermal deterioration of the lip seal 17 is caused by the annular groove 39.

(1-3) Since the wall 40α of the stepped portion 40 extends vertically, the lubricant oil moving along the surface of the drive shaft 15 is forced to flow from the stepped portion 40. Furthermore, machining for forming the stepped portion 40 on the drive shaft 15 is simplified.

(1-4) The portions connecting the bottom of the groove 39 with the walls extending from the groove 39 are curved. Thus, the stress applied to the drive shaft 15 does not focus on these connecting portions. Therefore, the annular groove 39 does not lower the strength of the drive shaft 15.

(1-5) Space A defined by the electromagnetic clutch 18 and the boss portion 16 communicates with the exterior of the compressor via the through holes 41 extending through the hub 21. Thus, since the pressure in the space A is maintained positive, the lubricant oil leakage from the lip seal 17 decreases. Furthermore, the lubricant oil flows smoothly to the oil absorber 36 via the oil passage 38. In this manner, the through holes 41, in addition to the stepped portion 40, improve the oil collecting performance.

(Second Embodiment)

Figure 3A:
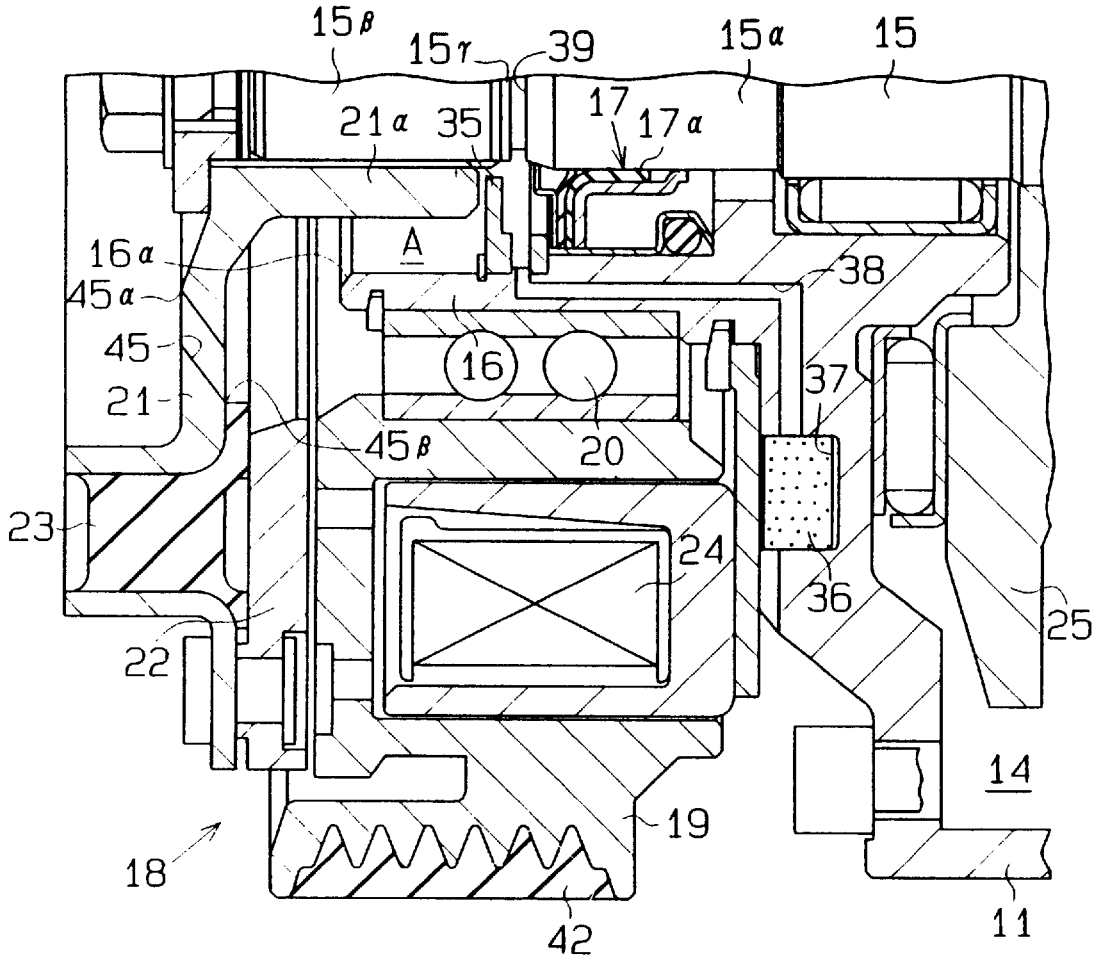
FIG. 3(*a*) is an enlarged cross-sectional view showing a main portion of a compressor of a second embodiment.
Figure 3B:
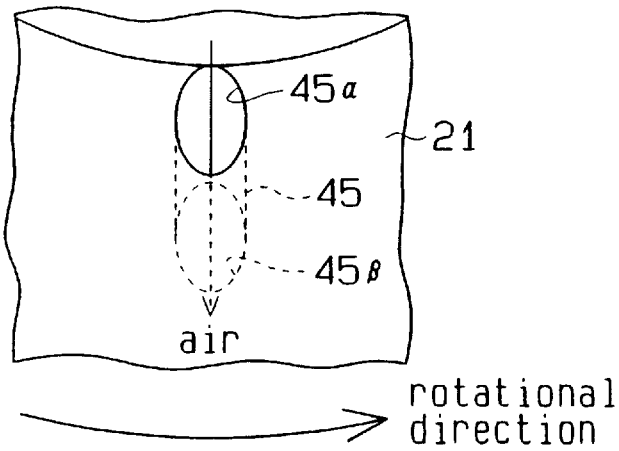

FIGS. 3(*a*) and 3(*b*) show a second embodiment. In this embodiment, an outer opening 45α of each through hole 45 is located inward in a radial direction of the hub 21, with respect to an inner opening 45β of the through hole 45. That is, the through hole 45 extends through the hub 21 in a radially inclined manner such that the hub 21 has a centrifugal-fan like structure. Therefore, when the hub 21 is rotated, ambient air is positively drawn into the space A through the through holes 45.

The second embodiment has the following advantages;

(2-1) Since the pressure in the space A is maintained positive, the effects of the first embodiment described in (1-5) are further improved.

(2-2) No components such as blower fins introducing ambient air into the space A need be provided separately from the through holes 45. The number of the parts is thus not increased, and the air sending structure is simplified.

(Third Embodiment)

Figure 4A:
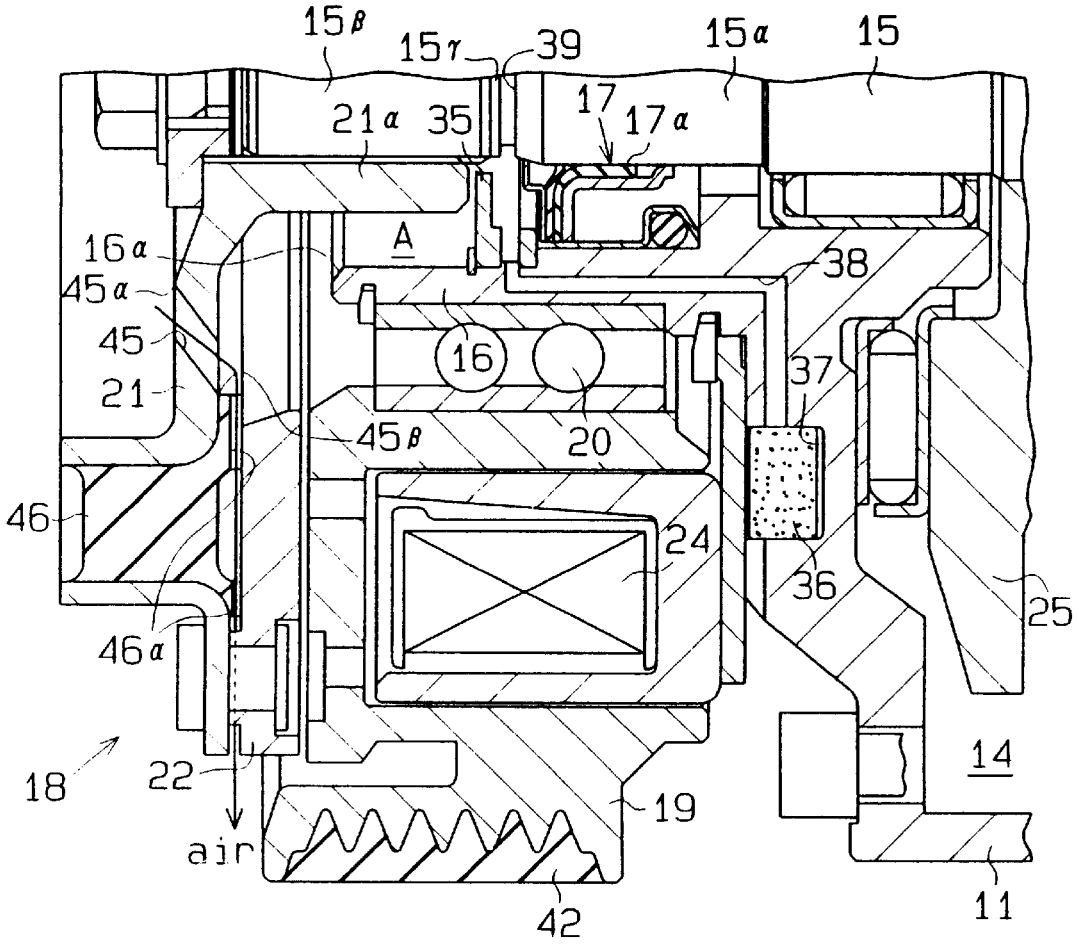
FIG. 4(*a*) is an enlarged cross-sectional view showing a main portion of a compressor of a third embodiment.
Figure 4B:
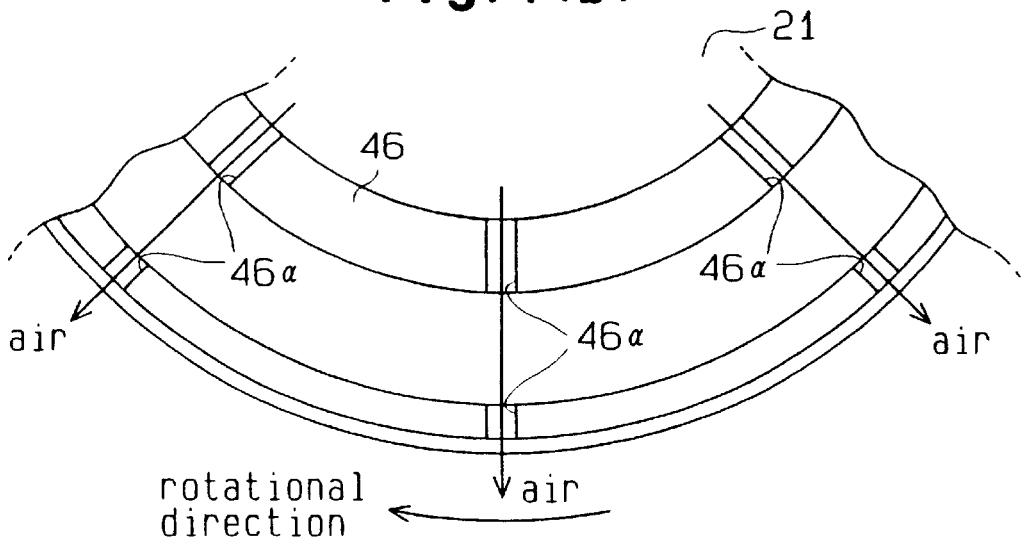

FIGS. 4(*a*) and 4(*b*) show a third embodiment. In this embodiment, in addition to the structure of the second embodiment, a plurality of vent holes 46α extend radially through the rubber bumper 46 in the vicinity of the surface of the bumper 46 opposed to the armature 22.

Thus, when the through holes 45 and the rubber bumper 46 function as a centrifugal fan during rotation of the hub 21, ambient air flows from the through holes 45 into the space A and then flows out through the vent holes 46α. In this manner, heat transfer from the hub 21 and the armature 22 is effectively improved, thus lowering the temperature of the entire electromagnetic clutch 18. Furthermore, the temperature in the vicinity of the lip seal 17 adjacent to the electromagnetic clutch 18 is effectively lowered. This suppresses thermal deterioration of the lip seal 17, thus preventing the seal performance of the lip seal 17 from decreasing.

Furthermore, since ambient air is introduced into the space A via the through holes 45, the pressure in the space A is maintained positive.

In addition, the present invention may be embodied as follows, without departing from the scope of the invention.

(1) The wall 40α of the stepped portion 40 need not extend perpendicular to the axis L, but may be slightly inclined rearward. Alternatively, the wall 40α of the stepped portion 40 may be inclined forward such that the edge of the stepped portion 40 projects toward the opposed wall.

(2) The oil absorber 36 may be fixed at a position in the interior space of the boss portion 16 in a radial direction from the stepped portion 40.

(3) Instead of the oil absorber 36, a drain tank may be arranged in the housings (11, 12, 13) of the compressor for retaining leaking lubricant oil.

(4) The oil passage 38 may be a tube arranged separately from the housings (11, 12, 13) of the compressor. In this case, maintenance of the compressor, for example, removal of an object caught in the oil passage 38, may be performed simply by removing the tube.

(5) Instead of providing the stopper 35, the inner side of the boss portion 16 may be slanted downwardly towards the opening of the oil passage 38.

(6) In the second and third embodiments, the through holes 45 extend through the hub 21 in a radially inclined manner. However, the through holes 45 may be inclined in a rotational direction of the hub 21.

(7) In the above embodiments, the rotational body is the electromagnetic clutch 18. However, a pulley having no mechanisms for intermittently transmitting drive force may be employed as the rotational body. In other words, the present invention may be embodied in a clutchless compressor.

(8) The annular groove 39 may be formed along the outer side of the bushing 21α (the rotary portion) provided on the hub 21, thus defining the stepped portion 40. In this case, the stopper 35 must be located closer to the opening 16α of the boss portion 16 than shown in FIG. 2.

(9) In the above embodiments, the present invention is embodied as a variable displacement swash-plate type compressor. However, the present invention may be embodied in, for example, a fixed displacement swash-plate type compressor, a scroll type compressor, or a wave cam type compressor.

(10) A blower fin may be provided on the hub 21 in the vicinity of the through holes 45 for introducing ambient air into the space A.

As described above in detail, the compressor according to the present invention assuredly prevents problems caused by oil leakage. Furthermore, the number of the parts is reduced, thus decreasing the number of the assembly steps. The assembly of the compressor is thus simplified. In addition, according to the present invention, the thermal deterioration of the seal decreases.

What is claimed is:

1. A compressor comprising:

a housing for supporting a compressing mechanism, wherein liquid lubricant is located within the housing for lubricating the compressing mechanism;

a drive shaft supported by the housing and connected to the compressing mechanism for driving the compressing mechanism, wherein a distal end of the drive shaft projects from the housing;

a boss projecting from the housing coaxially with the drive shaft, wherein the boss has a distal end though which the distal end of the drive shaft extends;

a rotating member connected coaxially with the drive shaft for transmitting rotary motion from a drive source to the drive shaft, wherein the rotating member is near the distal end of the drive shaft and is near the distal end of the boss, wherein a circumferential spacing between the boss and a projecting portion of the rotating member extending along the drive shaft defines an interior space;

a seal forming a barrier between the inside of the housing and the outside of the housing, wherein the seal contacts the drive shaft, and the drive shaft moves with respect to the seal;

a collector for collecting leaked liquid lubricant that flows from the inside of the housing past the seal along the drive shaft, wherein the collector has an entrance that is radially spaced from the drive shaft and is located between the seal and the distal end of the boss; and an air flow device on the rotating member for increasing the air pressure in the interior space.

2. The compressor according to claim 1 further comprising a centrifugal barrier surface formed on the drive shaft, the centrifugal barrier surface being a wall of an annular groove in the surface of the drive shaft, wherein the leaked liquid lubricant readily departs from the centrifugal barrier surface under the effect of centrifugal force, wherein the centrifugal barrier surface extends generally radially and is radially aligned with the entrance to the collector.

3. The compressor according to claim 2, wherein the centrifugal barrier surface is a planar surface extending perpendicular to the axis of the drive shaft.

4. The compressor according to claim 2, wherein the groove has a proximal wall and a distal wall, the distal wall being closer to the distal end of the drive shaft, and wherein the centrifugal barrier surface is formed by the proximal wall.

5. The compressor according to claim 2, wherein the maximum diameter of the centrifugal barrier surface is no greater than the maximum diameter of the drive shaft where the seal contracts the drive shaft.

6. The compressor according to claim 2, wherein the collector includes a ring stopper located on an inner surface of the boss at an axial position that is between the centrifugal barrier surface and the distal end of the boss.

7. The compressor according to claim 1, wherein the collector includes an oil passage leading from the entrance to a lubricant absorber.

8. The compressor according to claim 2, wherein the centrifugal barrier surface is an integral part of the drive shaft and is part of the surface of the drive shaft.

9. The compressor according to claim 1, wherein the air flow device comprises means for forming a hole in the rotating member to expose the interior space to the exterior of the compressor.

10. The compressor according to claim 9, wherein the hole is inclined to form a fan, wherein the fan positively increases the pressure in the interior space.

11. A compressor comprising:

a housing for supporting a compressing mechanism, wherein liquid lubricant is located within the housing for lubricating the compressing mechanism;

a drive shaft supported by the housing and connected to the compressing mechanism for driving the compressing mechanism, wherein distal end of the drive shaft projects from the housing;

a boss projecting from the housing coaxially with the drive shaft, wherein the boss has a distal end through which the distal end of the drive shaft extends;

a rotating member connected coaxially with the drive shaft for transmitting rotary motion from a drive source to the drive shaft, wherein the rotating member is near the distal end of the drive shaft and is near the distal end of the boss;

a seal forming a barrier between the inside of the housing and the outside of the housing, wherein the seal contacts the drive shaft, and the drive shaft moves with respect to the seal;

a collector for collecting leaked liquid lubricant that flows from the inside of the housing past the seal along the drive shaft, wherein the collector has an entrance that is radially spaced from the drive shaft and is located between the seal and the distal end of the boss; and a fan device on the rotating member for positively displacing air from the exterior of the compressor toward the vicinity of the distal end of the boss.

12. The compressor according to claim 11, wherein the fan device comprises means for forming an inclined hole in the rotating member to expose the interior space to the exterior of the compressor.

13. A compressor comprising:

a housing for supporting a compressing mechanism, wherein liquid lubricant is located within the housing for lubricating the compressing mechanism;

a drive shaft supported by the housing and connected to the compressing mechanism for driving the compressing mechanism, wherein a distal end of the drive shaft projects from the housing;

a boss projecting from the housing coaxially with the drive shaft, wherein the boss has a distal end through which the distal end of the drive shaft extends;

a rotating member connected coaxially with the drive shaft for transmitting rotary motion from a drive source to the drive shaft, wherein the rotating member is located near the distal end of the drive shaft and near the distal end of the boss, wherein a circumferential spacing between the boss and a projecting portion of the rotating member extending along the drive shaft defines an interior space;

a seal forming a barrier between the inside of the housing and the outside of the housing, wherein the seal contacts the drive shaft, and wherein the seal is attached to the housing and the drive shaft moves with respect to the seal;

a collector for collecting leaked liquid lubricant that flows from the inside of the housing past this seal along the drive shaft, wherein the collector has an entrance that is radially spaced from the drive shaft and is located between the seal and the distal end of the boss; and means for forming a through hole in the rotating member to communicate the interior space with the exterior of the compressor such that the pressure in the interior space is maintained positive.

14. The compressor according to claim 13, wherein the through hole is inclined to form a fan, wherein the fan positively displaces air to increase the pressure in the interior space when the rotating member is rotated.

15. The compressor according to claim 13, wherein the rotating member includes a vent hole, wherein, when the rotating member is rotated, air flows from the through hole into the interior space and flows out through the vent hole.

16. The compressor according to claim 15, wherein the through hole is inclined to form a fan, an the vent hole extends radially.

* * * * *